US009928795B2

(12) United States Patent
Gong

(10) Patent No.: US 9,928,795 B2
(45) Date of Patent: Mar. 27, 2018

(54) GATE DRIVER ON ARRAY CIRCUIT AND DISPLAY DEVICE

(71) Applicant: WUHAN CHINA STAR OPTOELECTRONICS TECHNOLOGY CO., LTD., Wuhan, Hubei (CN)

(72) Inventor: Qiang Gong, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 192 days.

(21) Appl. No.: 14/907,571

(22) PCT Filed: Jan. 13, 2016

(86) PCT No.: PCT/CN2016/070816

§ 371 (c)(1),
(2) Date: Jan. 26, 2016

(87) PCT Pub. No.: WO2017/113443

PCT Pub. Date: Jul. 6, 2017

(65) Prior Publication Data

US 2017/0323608 A1 Nov. 9, 2017

(30) Foreign Application Priority Data

Dec. 31, 2015 (CN) ..... 2015 1 1027578

(51) Int. Cl.
*G09G 3/36* (2006.01)

(52) U.S. Cl.
CPC ..... *G09G 3/3677* (2013.01); *G09G 3/3648* (2013.01); *G09G 2310/0283* (2013.01); *G09G 2310/0289* (2013.01); *G09G 2310/08* (2013.01)

(58) Field of Classification Search
CPC ... G09G 3/3677; G09G 2310/08; G11C 19/28
See application file for complete search history.

(56) References Cited

U.S. PATENT DOCUMENTS

2007/0152943 A1* 7/2007 Hwang ..... G02F 1/13306 345/98
2008/0101529 A1* 5/2008 Tobita ..... G09G 3/3677 377/64
2010/0260312 A1* 10/2010 Tsai ..... G09G 3/3677 377/79
2012/0256817 A1* 10/2012 Chen ..... G11C 19/28 345/92

* cited by examiner

*Primary Examiner* — Shaheda Abdin
(74) *Attorney, Agent, or Firm* — Soroker Agmon Nordman

(57) ABSTRACT

A gate driver on array (GOA) circuit and a display device are provided. The GOA circuit is formed on an array substrate, and has a plurality of GOA units. Each of the GOA units has a drive module, a pull-down module, a pull-down output module, and a pull-up output module, which has a forward and reverse scanning function and avoids providing a forward and reverse scanning control unit and receiving a signal of the forward and reverse scanning control unit by connecting a circuit input of a pull-down output module and a drive module.

11 Claims, 4 Drawing Sheets

GATE DRIVER ON ARRAY CIRCUIT AND DISPLAY DEVICE

FIELD OF THE INVENTION

The present invention relates to a circuit and a display device, and more particularly to a gate driver on array circuit and a display device.

BACKGROUND OF THE INVENTION

GOA (Gate Driver on Array, the array substrate row driver) technology refers directly to the gate driving circuit formed on the array substrate, a silicon wafer instead of the external one driver chip technology; GOA application techniques may reduce the program production process, lower the product cost, and improve the liquid crystal display integration panel. Recently, GOA technology has been widely used, the GOA panel can be distinguished into a unilateral GOA panel (gate drive circuit is disposed on a side of an array substrate) and a bilateral GOA panel (gate drive circuits are disposed on two sides of an array substrate).

The technology of low-temperature polysilicon thin film transistors continues to develop, and has a characteristic of high carrier mobility. Integrated circuits are disposed on the periphery of the panel, which has become a focus of attention. The technology of system on panel gets more research and development and is gradually becoming a reality.

However, a GOA circuit of the panel which drives the gate has a forward and reverse scanning function, and the forward and reverse scanning function is achieved by disposing a forward and reverse scanning control unit (U2D and D2U) and receiving the signals of the forward and reverse scanning control unit. Thus the signal lines and the device of the circuit could be added, and not satisfy requirements for a narrow border, and a power consumption of the circuit could be increased.

As a result, it is necessary to provide the GOA circuit to solve the problems existing in the conventional technologies, as described above.

SUMMARY OF THE INVENTION

A primary object of the present invention is to provide a gate driver on array (GOA) circuit, which has a forward and reverse scanning function and avoids providing a forward and reverse scanning control unit and receives a signal of the forward and reverse scanning control unit by connecting a circuit input of a pull-down output module and a drive module.

To achieve the above object, the present invention provides a GOA circuit, the GOA circuit includes a plurality of GOA units, each of the GOA units are provided with an (n−1)th level input end, an (n+1)th level input end, a first clock signal input end, a second clock signal input end, a high voltage-level input end, a low voltage-level input end, and a output end, and the GOA circuit comprises a drive module, a pull-down module, a pull-down output module, and a pull-up output module. The drive module electrically connects to the (n−1)th level input end and the (n+1)th level input end; the pull-down module electrically connects to the drive module, the first clock signal input end, and the high voltage-level input end; the pull-down output module electrically connects to the first clock signal input end, the high voltage-level input end, the low voltage-level input end, and the output end, wherein the pull-down output module comprises a circuit input end electrically connected to the drive module and the pull-down module, and a pull-down node electrically connected to the pull-down module; the pull-up output module electrically connects to the second clock signal input end and the output end, wherein the pull-up output module comprises a pull-up node electrically connected to the pull-down module.

In one embodiment of the present invention, the drive module comprises a pre-stage input diode electrically connected to the (n−1)th level input end and the circuit input end, and a post-stage input diode electrically connected to the (n+1)th level input end and the circuit input end.

In one embodiment of the present invention, the pull-down module comprises a first TFT, a second TFT, and a third TFT; the first TFT includes a gate electrically connected to the high voltage-level input end, a first electrode end electrically connected to the pull-up node of the pull-up output module, and a second electrode end electrically connected to the circuit input end of the pull-down output module; the second TFT includes a gate electrically connected to the first clock signal input end, and a first electrode end electrically connected to the second electrode end of the first TFT; the third TFT includes a first electrode end electrically connected to a second electrode end of the second TFT, and a second electrode end electrically connected to the pull-down node of the pull-down output module.

In one embodiment of the present invention, the pull-down output module comprises a fourth TFT, a fifth TFT, a sixth TFT, and a pull-down capacitor; the fourth TFT includes a gate electrically connected to the circuit input end, and a first electrode end electrically connected to a gate of the third TFT; the fifth TFT includes a gate electrically connected to a second electrode end of the fourth TFT, a first electrode end electrically connected to the first electrode end of the fourth TFT, and a second electrode end electrically connected to the high voltage-level input end; the sixth TFT includes a gate electrically connected to the pull-down node, a first electrode end electrically connected to the output end, and a second electrode end electrically connected to the low voltage-level input end; the pull-down capacitor electrically connects to the pull-down node and the low voltage-level input end.

In one embodiment of the present invention, the pull-up output module comprises a seventh TFT, and a pull-up capacitor; the seventh TFT includes a gate electrically connected to the pull-up node, a first electrode end electrically connected to the second clock signal input end, and a second electrode end electrically connected to the output end; the pull-up capacitor electrically connects to the pull-up node and the output end.

In one embodiment of the present invention, the first TFT to the seventh TFTs are N type TFTs, and the GOA circuit is formed on an array substrate.

In one embodiment of the present invention, the GOA circuit drives a pixel array by at least four of the GOA units.

In one embodiment of the present invention, the pixel array has two opposite sides electrically connected to four of the first GOA units which are cascaded and four of the second GOA units which are cascaded, respectively, and the first and second GOA units are controlled through four clock signals.

In one embodiment of the present invention, the pixel array has two opposite sides electrically connected to eight of the GOA units which are cascaded, and the GOA units are controlled through two clock signals.

To achieve the above object, the present invention provides a display device, the display device comprises an array substrate, and a GOA circuit formed on the array substrate.

As described above, the GOA circuit of the present invention can have a forward and reverse scanning function and avoid providing a forward and reverse scanning control unit and receiving a signal of the forward and reverse scanning control unit by disposing diodes of the drive module and connecting the diodes and the circuit input end. Thus an area of the GOA circuit can be reduced, a narrow border is designed easily, and a power consumption of the GOA circuit can be lowered.

DETAILED DESCRIPTION OF THE PREFERRED EMBODIMENTS

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, and etc., are only directions by referring to the accompanying drawings, and thus the used directional terms are used to describe and understand the present invention, but the present invention is not limited thereto.

Figure 1:
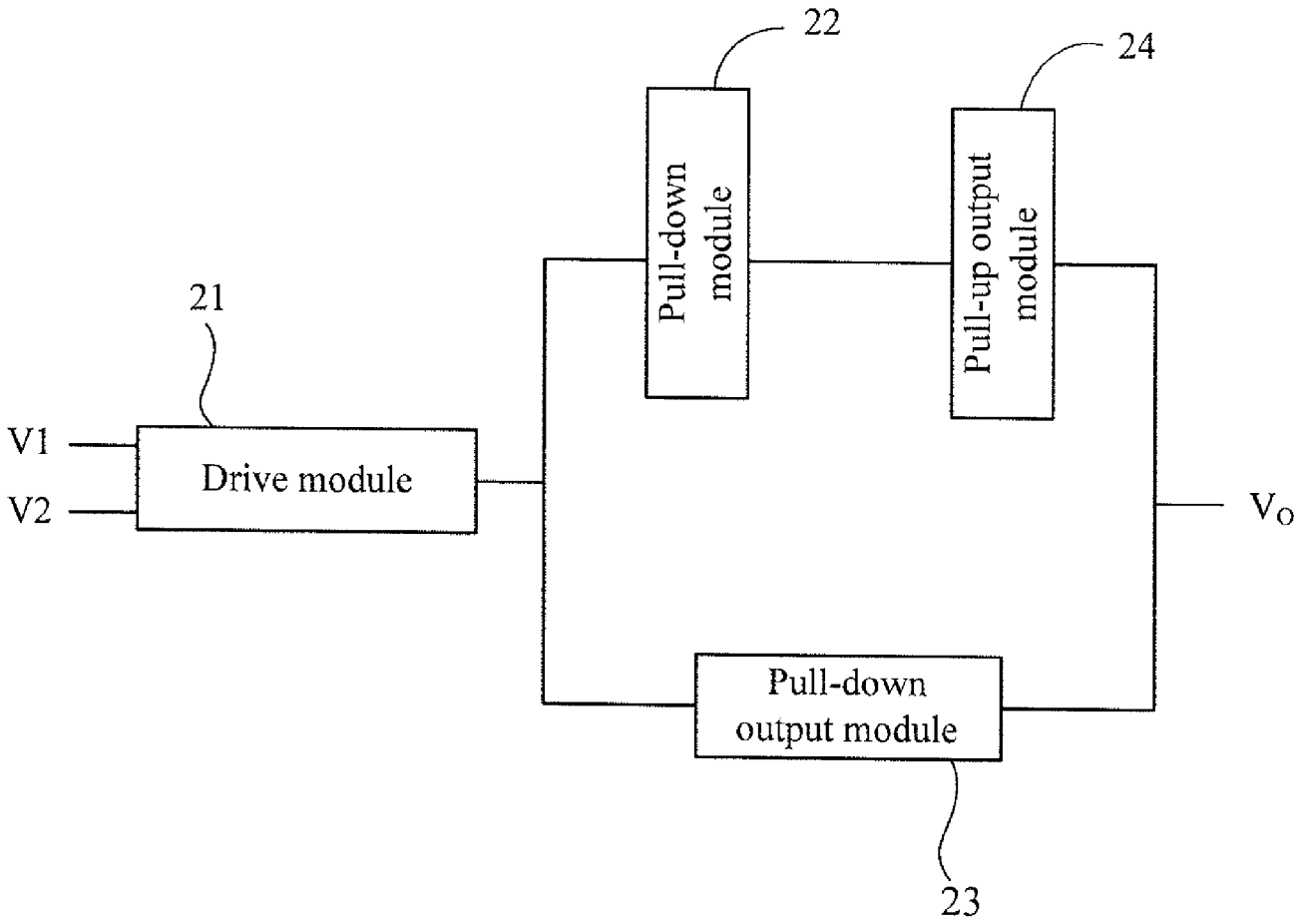
FIG. 1 is a block diagram view of a GOA circuit according to a preferred embodiment of the present invention.
Figure 2:
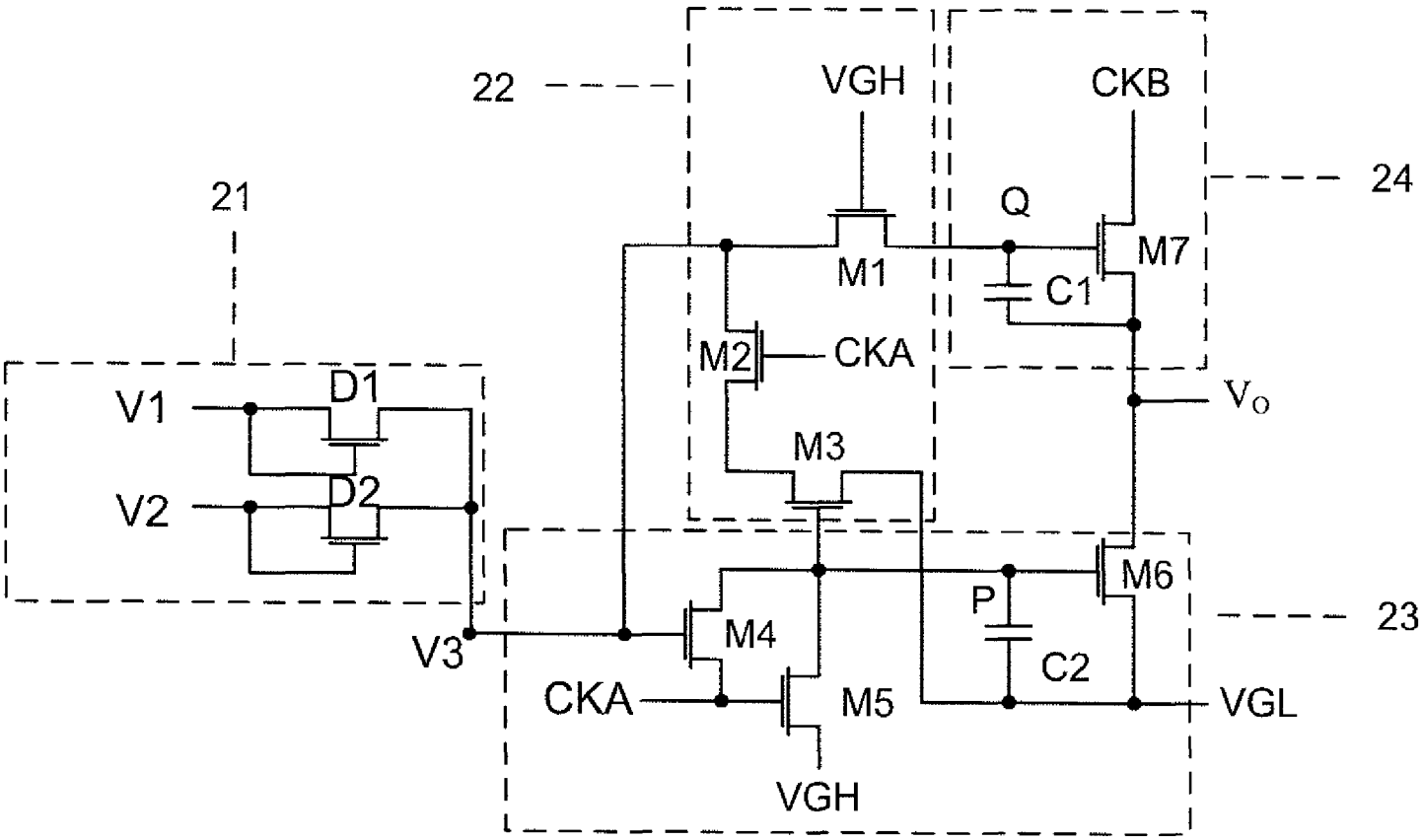
FIG. 2 is a schematic diagram view of a GOA circuit according to the preferred embodiment of the present invention.

Refer to FIGS. 1 and 2, which are a gate driver on array (GOA) circuit according to a preferred embodiment of the present invention. The GOA circuit includes a plurality of GOA units 100, each of the GOA units 100 is provided with an (n−1)th level input end V1, an (n+1)th level input end V2, a first clock signal input end CKA, a second clock signal input end CKB, a high voltage-level input end VGH, a low voltage-level input end VGL, and a output end Vo. The GOA circuit 100 comprises a drive module 21, a pull-down module 22, a pull-down output module 23, and a pull-up output module 24. The detailed structure of each component, assembly relationships, and principle of operation in the present invention will be described in detail hereinafter.

Refer to FIGS. 1 and 2, the drive module 21 electrically connects to the (n−1)th level input end V1 for receiving a signal G[N−1] and the (n+1)th level input end V2 for receiving a signal G[n+1] in the preferred embodiment of the present invention.

Refer to FIGS. 1 and 2, the drive module 21 comprises a pre-stage input diode D1 and a post-stage input diode D2. The pre-stage input diode D1 electrically connects to the (n−1)th level input end V1 and the circuit input end V3. The post-stage input diode D2 electrically connects to the (n+1) th level input end V2 and the circuit input end V3. The pre-stage input diode D1 and the post-stage input diode D2 are formed an equivalent circuit by electrically connecting a gate and a first electrode end of a first thin film transistor (TFT) in the preferred embodiment of the present invention. An equivalent circuit is also provided a diode to connect the circuit input end V3 in other embodiments, which is not limited.

Refer to FIGS. 1 and 2, the pull-down module 22 electrically connects to the drive module 21, the first clock signal input end CKA, and the high voltage-level input end VGH. Furthermore, the pull-down module 22 has a first TFT M1, a second TFT M2, and a third TFT M3.

Refer to FIGS. 1 and 2, the first TFT M1 includes a gate, a first electrode end, and a second electrode end. The gate of the first TFT M1 electrically connects to the high voltage-level input end VGH, the first electrode end of the first TFT M1 electrically connects to a pull-up node Q of the pull-up output module 24, and the second electrode end of the first TFT M1 electrically connects to the circuit input end V3 of the pull-down output module 23.

Refer to FIGS. 1 and 2, the second TFT M2 includes a gate, a first electrode end, and a second electrode end. The gate of the second TFT M2 electrically connects to the first clock signal input end CKA, and the first electrode end M1 of the second TFT M2 electrically connects to the second electrode end of the first TFT M1.

Refer to FIGS. 1 and 2, the third TFT M3 includes a first electrode end, and a second electrode end. The first electrode end of the third TFT M3 electrically connects to the second electrode end of the second TFT M2, and the second electrode end of the third TFT M3 electrically connects to a pull-down node P of the pull-down output module 23.

Refer to FIGS. 1 and 2, the pull-down output module 23 electrically connects to the first clock signal input end CKA, the high voltage-level input end VGH, the low voltage-level input end VGL, and the output end Vo, wherein the pull-down output module 23 comprises a circuit input end V3 and pull-down node P, the circuit input end V3 electrically connects to the drive module 21 and the pull-down module 22, the pull-down node P electrically connects to the pull-down module 22. Furthermore, the pull-down output module 23 comprises a fourth TFT M4, a fifth TFT M5, a sixth TFT M6, and a pull-down capacitor C2.

Refer to FIGS. 1 and 2, the fourth TFT M4 includes a gate, and a first electrode end. The gate of the fourth TFT M4 electrically connects to the circuit input end V3, and the first electrode end of the fourth TFT M4 electrically connects to a gate of the third TFT M3.

Refer to FIGS. 1 and 2, the fifth TFT M5 includes a gate, a first electrode end, and a second electrode end. The gate of the fifth TFT M5 electrically connects to a second electrode end of the fourth TFT M4, the first electrode end of the fifth TFT M5 electrically connects to the first electrode end of the fourth TFT M4, and the second electrode end of the fifth TFT M5 electrically connects to the high voltage-level input end VGH.

Refer to FIGS. 1 and 2, the sixth TFT M6 includes a gate, a first electrode end, and a second electrode end. The gate of the sixth TFT M6 electrically connects to the pull-down node P, the first electrode end of the sixth TFT M6 electrically connects to the output end Vo, and the second electrode end of the sixth TFT M6 electrically connects to the pull-down node P, and the low voltage-level input end VGL.

Refer to FIGS. 1 and 2, the pull-up output module 24 electrically connects to the second clock signal input end CKB and the output end Vo, wherein the pull-up output module 24 comprises the pull-up node Q electrically connected to the pull-down module 22. Furthermore, the pull-up output module 24 has a seventh TFT M7 and a pull-up capacitor C1.

Refer to FIGS. 1 and 2, the seventh TFT M7 includes a gate, a first electrode end, and a second electrode end. The gate of the seventh TFT M7 electrically connects to the pull-up node Q, the first electrode end of the seventh TFT M7 electrically connects to the second clock signal input end CKB, and the second electrode end of the seventh TFT M7 electrically connects to the output end Vo. The pull-up capacitor C1 electrically connects to the pull-up node Q and the output end Vo.

Refer to FIGS. 1 and 2, the first TFT M1 to the seventh TFT M7 are N type TFTs, and the GOA circuit is formed on an array substrate (not shown) in the preferred embodiment of the present invention.

Figure 3:
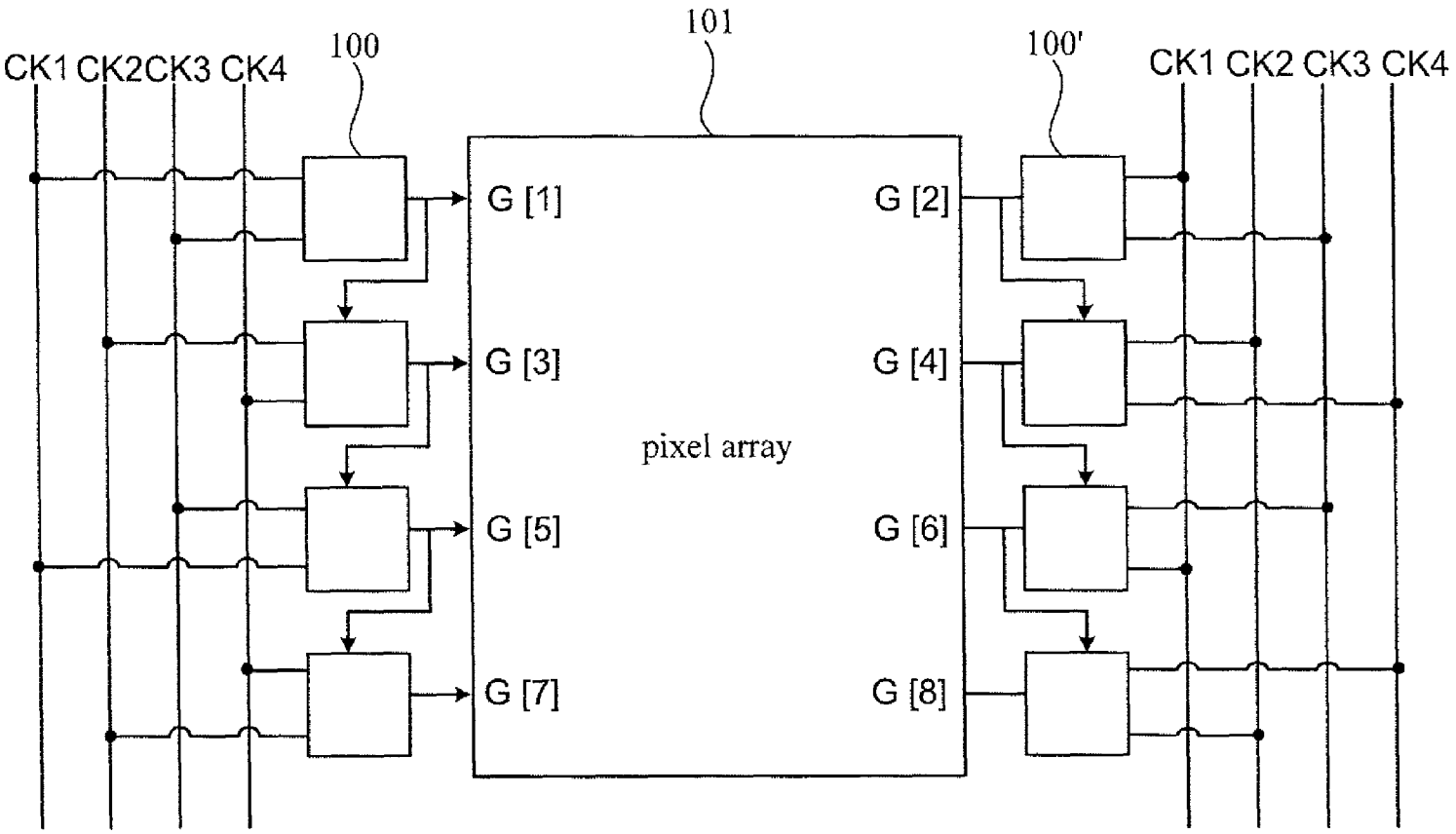
FIG. 3 is a schematic diagram view of a GOA circuit driving an array substrate according to the preferred embodiment of the present invention.
Figure 4:
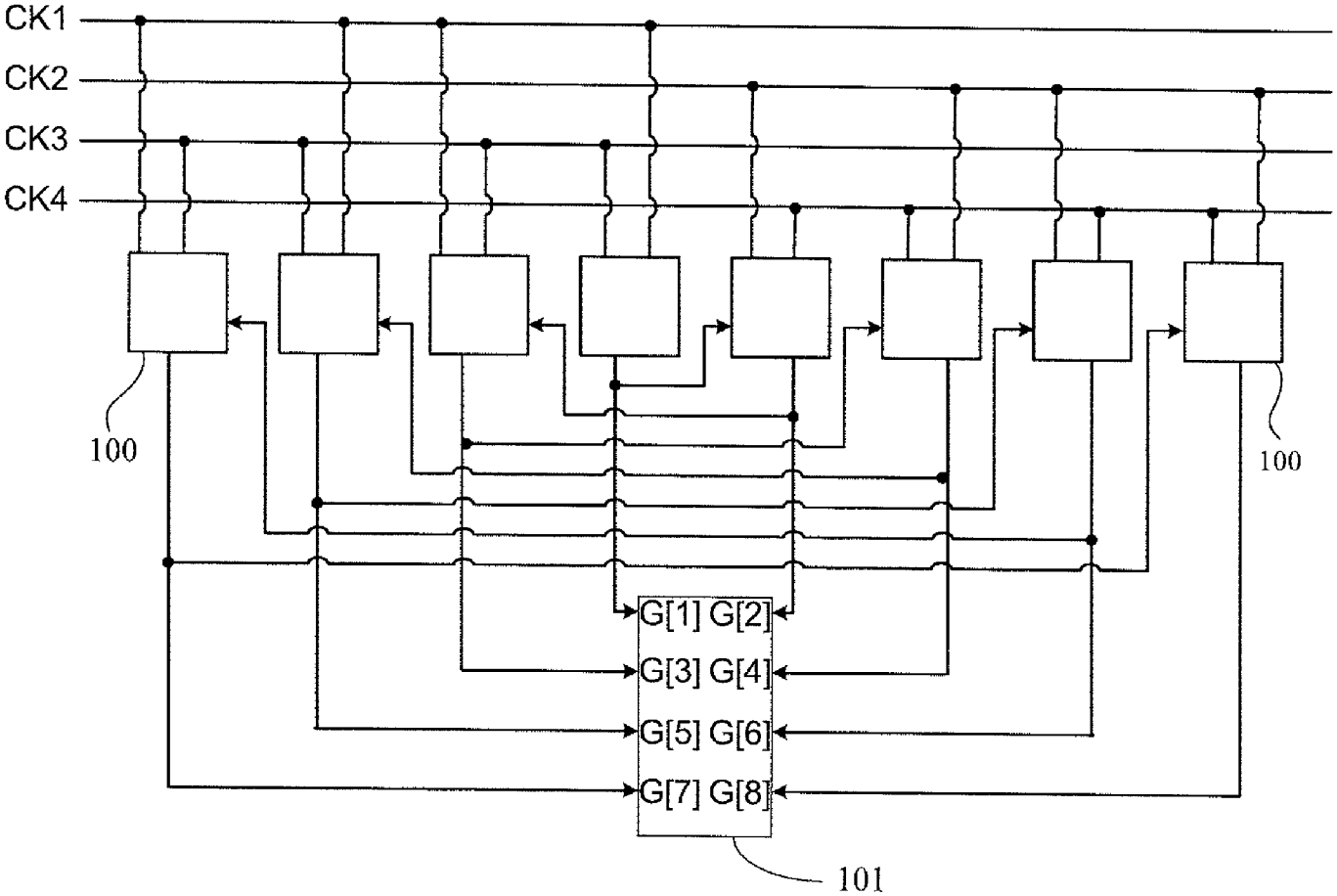
FIG. 4 is a schematic diagram view of a GOA circuit driving an array substrate according to another preferred embodiment of the present invention.

Refer to FIGS. 3 and 4, the GOA circuit drives a pixel array 101 by at least four of the GOA units 100, such as the GOA circuit drives a pixel array 101 by eight of the GOA units 100 in FIG. 3 or 4. For instance, a pixel array 101 has two opposite sides electrically connects to four of the first GOA units 100 which are cascaded and four of the second GOA units 100' which are cascaded, respectively, wherein the first and second GOA units 100, 100' are controlled through four clock signals CK1, CK2, CK3, CK4 according an embodiment of the present invention in FIG. 3, and a pixel array 101 has two opposite sides electrically connected to eight of the GOA units 100 which are cascaded, and the GOA units 100 are controlled through two clock signals according a embodiment of the present invention in FIG. 4, wherein each side of the pixel array 101 is controlled by two clock signals, two clock signals on a side are CK1/CK3, and two clock signals on the other side are CK2/CK4.

Furthermore, the present invention also provides a display device (not shown), the display device comprises an array substrate, and a GOA circuit formed on the array substrate.

The pull-up output module 24 can receive clock signals through the first clock signal input end CKA and the second clock signal input end CKB. The first clock signal input end CKA provides a high level voltage when the signal G[n+1] that the (n−1)th level input end V1 received is a high level voltage, a voltage of the first clock signal input end CKA pulls up a voltage of the pull-up node Q; a voltage of the (n−1)th level input end V1 pulls up a voltage of the pull-down node P by receiving the signal G[n−1]; In next clock signal, the voltage of the first clock signal input end CKA is low level voltage, a voltage of the second clock signal input end CKB is pulled up, a voltage of the first clock signal input end CKA pulls down a voltage of the pull-up node Q, and a voltage of the pull-down node P keeps a high level voltage, so that the second clock signal input end CKB can output a high level voltage to G[n] in FIGS. 3 and 4. In the pull-down module 22, a voltage of the pull-down node P is pulled down to a low level voltage when the voltage of the pull-up node Q and the voltage of the second clock signal input end CKB are high level voltages. In the pull-down output module 23, the output end Vo can output a low level voltage when the voltage of the first clock signal input end CKA is a high level voltage, and the voltage of the pull-up node Q can be pulled up.

As described above, the GOA circuit of the present invention can have a forward and reverse scanning function and avoid providing a forward and reverse scanning control unit and receiving a signal of the forward and reverse scanning control unit by disposing diodes of the drive module 21 and connecting the diodes and the circuit input end V3. Thus an area of the GOA circuit can be reduced, a narrow border is designed easily, and a power consumption of the GOA circuit can be lowered.

The present invention has been described with preferred embodiments thereof and it is understood that many changes and modifications to the described embodiments can be carried out without departing from the scope and the spirit of the invention that is intended to be limited only by the appended claims.

What is claimed is:

1. A gate driver on array (GOA) circuit, including a plurality of GOA units, each of the GOA units provided with an (n−1)th level input end, an (n+1)th level input end, a first clock signal input end, a second clock signal input end, a high voltage-level input end, a low voltage-level input end, and a output end, and comprising:

a drive module electrically connected to the (n−1)th level input end and the (n+1)th level input end;

a pull-down module electrically connected to the drive module, the first clock signal input end, and the high voltage-level input end;

a pull-down output module electrically connected to the first clock signal input end, the high voltage-level input end, the low voltage-level input end, and the output end, wherein the pull-down output module comprises a circuit input end electrically connected to the drive module and the pull-down module, and a pull-down node electrically connected to the pull-down module;

a pull-up output module electrically connected to the second clock signal input end and the output end, wherein the pull-up output module comprises a pull-up node electrically connected to the pull-down module;

a first thin film transistor (TFT) including a gate electrically connected to the high voltage-level input end, a first electrode end electrically connected to the pull-up node of the pull-up output module, and a second electrode end electrically connected to the circuit input end of the pull-down output module;

a second TFT including a gate electrically connected to the first clock signal input end, and a first electrode end electrically connected to the second electrode end of the first TFT;

a third TFT including a first electrode end electrically connected to a second electrode end of the second TFT, and a second electrode end electrically connected to the pull-down node of the pull-down output module;

a fourth TFT including a gate electrically connected to the circuit input end, and a first electrode end electrically connected to a gate of the third TFT;

a fifth TFT including a gate electrically connected to a second electrode end of the fourth TFT, a first electrode end electrically connected to the first electrode end of the fourth TFT, and a second electrode end electrically connected to the high voltage-level input end;

a sixth TFT including a gate electrically connected to the pull-down node, a first electrode end electrically connected to the output end, and a second electrode end electrically connected to the low voltage-level input end; and a pull-down capacitor electrically connected to the pull-down node and the low voltage-level input end;

wherein the GOA circuit drives a pixel array by four of the GOA units, and the drive module comprises a pre-stage input diode electrically connected to the (n−1)th level input end and the circuit input end, and a post-stage input diode electrically connected to the (n+1)th level input end and the circuit input end.

2. The GOA circuit according to claim 1, wherein the pull-up output module comprises:

a seventh TFT including a gate electrically connected to the pull-up node, a first electrode end electrically connected to the second clock signal input end, and a second electrode end electrically connected to the output end; and a pill-up capacitor electrically connected to the pull-up node and the output end.

3. The GOA circuit according to claim 2, wherein the first TFT to the seventh TFT are N type TFTs, and the GOA circuit is formed on an array substrate.

4. A gate driver on array (GOA) circuit, including a plurality of GOA units, each of the GOA units being provided with an (n−1)th level input end, an (n+1)th level input end, a first clock signal input end, a second clock signal input end, a high voltage-level input end, a low voltage-level input end, and a output end, and comprising:

a drive module electrically connected to the (n−1)th level input end and the (n+4)th level input end;

a pull-down module electrically connected to the drive module, the first clock signal input end, and the high voltage-level input end;

a pull-down output module electrically connected to the first clock signal input end, the high voltage-level input end, the low voltage-level input end, and the output end, wherein the pull-down output module comprises a circuit input end electrically connected to the drive module and the pull-down module, and a pull-down node electrically connected to the pull-down module; and a pull-up output module electrically connected to the second clock signal input end and the output end, wherein the pull-up output module comprises a pull-up node electrically connected to the pull-down module;

a first thin film transistor (TFT) including a gate electrically connected to the high voltage-level input end, a first electrode end electrically connected to the pull-up node of the pull-up output module, and a second electrode end electrically connected to the circuit input end of the pull-down output module;

a second TFT including a gate electrically connected to the first clock signal input end, and a first electrode end electrically connected to the second electrode end of the first TFT;

a third TFT including a first electrode end electrically connected to a second electrode end of the second TFT, and a second electrode end electrically connected to the pull-down node of the pull-down output module;

a fourth TFT including a gate electrically connected to the circuit input end, and a first electrode end electrically connected to a gate of the third TFT;

a fifth TFT including a gate electrically connected to a second electrode end of the fourth TFT, a first electrode end electrically connected to the first electrode end of the fourth TFT, and a second electrode end electrically connected to the high voltage-level input end;

a sixth TFT including a gate electrically connected to the pull-down node, a first electrode end electrically connected to the output end, and a second electrode end electrically connected to the low voltage-level input end; and a pull-down capacitor electrically connected to the pull-down node and the low voltage-level input end.

5. The GOA circuit according to claim 4, wherein the drive module comprises a pre-stage input diode electrically connected to the (n−1)th level input end and the circuit input end, and a post-stage input diode electrically connected to the (n+1)th level input end and the circuit input end.

6. The GOA circuit according to claim 4, wherein the pull-up output module comprises:

a seventh TFT including a gate electrically connected to the pull-up node, a first electrode end electrically connected to the second clock signal input end, and a second electrode end electrically connected to the output end; and a pull-up capacitor electrically connected t pull-up node and the output end.

7. The GOA circuit according to claim 6, wherein the first ITT to the seventh ITT are N type TFTs, and the GOA circuit is formed on an array substrate.

8. The GOA circuit according to claim 4, wherein the GOA circuit drives a pixel array by at least four of the GOA units.

9. The GOA circuit according to claim 8, wherein the pixel array has two opposite sides electrically connected to four of the first GOA units which are cascaded and four of the second GOA units which are cascaded, respectively, and the first and second GOA units are controlled through four clock signals.

10. The GOA circuit according to claim 8, wherein the pixel array has two opposite sides electrically connected to eight of the GOA units which are cascaded, and the GOA units are controlled through two clock signals.

11. A display device, comprising:

an array substrate; and a gate driver on array (GO) circuit according to claim 4 formed on the array substrate.

* * * * *